US007780098B2

(12) United States Patent
Foster et al.

(10) Patent No.: US 7,780,098 B2
(45) Date of Patent: Aug. 24, 2010

(54) FAN SPRAY PATTERN INDEXING NOZZLE FOR A TRIGGER SPRAYER

(75) Inventors: Donald D. Foster, St. Charles, MO (US); Philip P. Nelson, Wildwood, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 629 days.

(21) Appl. No.: 11/484,252

(22) Filed: Jul. 11, 2006

(65) Prior Publication Data

US 2008/0011882 A1 Jan. 17, 2008

(51) Int. Cl.
*A62C 31/02* (2006.01)

(52) U.S. Cl. ..... 239/394; 239/391; 239/392; 239/333; 239/436; 239/481; 239/539; 222/383.1

(58) Field of Classification Search ..... 239/333, 239/343, 391, 481, 539, 597, 392, 394, 436; 222/383.1

See application file for complete search history.

(56) References Cited

U.S. PATENT DOCUMENTS 3,967,765 A * 7/1976 Micallef ..... 222/554
4,020,982 A * 5/1977 Micallef ..... 222/554
4,890,792 A * 1/1990 Martin et al. ..... 239/343
5,526,985 A * 6/1996 Martin ..... 239/478
5,890,655 A * 4/1999 Collias et al. ..... 239/107
6,557,783 B1 * 5/2003 Foster et al. ..... 239/343
6,659,369 B1 12/2003 Foster et al.
6,772,966 B2 8/2004 Foster et al.
2004/0149837 A1 8/2004 Foster
2006/0065765 A1 * 3/2006 Hester et al. ..... 239/589.1

OTHER PUBLICATIONS

International Search Report WO2008/008588A3, publication date Sep. 4, 2008.

* cited by examiner

*Primary Examiner*—Dinh Q Nguyen
(74) *Attorney, Agent, or Firm*—MWV Intellectual Property Group

(57) ABSTRACT

A trigger sprayer has a nozzle assembly that dispenses a spray of liquid in a fan pattern that is selectively oriented horizontally or vertically. The nozzle assembly includes a nozzle housing and nozzle cap mounted on the nozzle housing, where the nozzle cap is rotatable relative to the nozzle housing to direct a fan spray pattern of liquid from the nozzle cap in both a vertical and horizontal orientation, and prevent the discharge of liquid from the nozzle cap in cap positions between the horizontal and vertical orientations.

5 Claims, 8 Drawing Sheets

FAN SPRAY PATTERN INDEXING NOZZLE FOR A TRIGGER SPRAYER

BACKGROUND OF THE INVENTION (1) Field of the Invention

The present invention pertains to a trigger sprayer having a nozzle assembly that dispenses a spray of liquid in a fan pattern that is selectively oriented horizontally or vertically. In particular, the present invention pertains to the construction of a nozzle housing and nozzle cap mounted on the nozzle housing, where the nozzle cap is rotatable relative to the nozzle housing to direct a fan spray pattern of liquid from the nozzle cap in both a vertical and horizontal orientation, and prevent the discharge of liquid from the nozzle cap in cap positions between the horizontal and vertical orientations.

(2) Description of the Related Art

Trigger sprayers are hand held and hand operated sprayers that dispense liquid from a bottle attached to the sprayer. The typical trigger sprayer has a sprayer housing that is attached to the bottle by a threaded connection or a bayonet-type connection. The sprayer housing contains a pump chamber, a liquid supply passage that communicates the pump chamber through a dip tube with the liquid inside the container attached to the sprayer housing, and a liquid discharge passage that communicates with the pump chamber.

A piston is mounted on the sprayer housing for reciprocating movement through the pump chamber. A trigger is also mounted on the sprayer housing for pivoting movement of the trigger relative to the sprayer housing. The trigger is operatively connected to the pump piston to cause the pump piston to reciprocate through the pump chamber in response to manually squeezing and releasing the trigger.

In the typical operation of a trigger sprayer, the trigger sprayer is held in the hand of an operator and the trigger of the trigger sprayer is manually squeezed and released. The manual squeezing and releasing of the trigger sprayer trigger causes the pump piston to reciprocate in the pump chamber. The reciprocation of the pump piston draws liquid from the bottle through the dip tube and the liquid supply passage to the pump chamber, and pumps the liquid from the pump chamber through the liquid discharge passage of the sprayer housing. A nozzle assembly attached to the sprayer housing controls the discharge of liquid from the sprayer housing.

Known trigger sprayer nozzle assemblies discharge liquid from the trigger sprayers in a variety of different discharge spray patterns. Known nozzle assemblies discharge liquid in a conical spray pattern, in a linear stream pattern, and discharge liquid as a foam in the most commonly known discharge patterns. However, in certain uses of a trigger sprayer, other liquid discharge patterns may be more desirable.

SUMMARY OF THE INVENTION

The present invention provides a trigger sprayer having a nozzle assembly that is capable of discharging liquid from a trigger sprayer in a planar, fan pattern of spray discharge. This novel discharge pattern of spray from the nozzle assembly of the invention is similar to the conical spray discharge pattern, but is a more flat, fan-shaped spray discharge pattern. In certain applications, the flat, fan spray discharge pattern of the present invention is more desirable than the conical spray discharge pattern of the prior art.

The nozzle assembly of the invention is designed to be used with essentially any known type of manually operated trigger sprayer. The nozzle assembly is attached to the liquid discharge passage of the trigger sprayer, where the nozzle assembly receives a flow liquid discharged from the trigger sprayer on manual operation of the trigger sprayer.

The nozzle assembly of the invention is comprised of only two component parts, a nozzle housing and a nozzle cap mounted for rotation on the nozzle housing. The two-piece construction of the nozzle assembly reduces manufacturing costs.

The nozzle housing is constructed to be attachable to the trigger sprayer housing to receive liquid discharged from the trigger sprayer housing on operation of the trigger sprayer. The nozzle housing has a liquid discharge passage that extends through the nozzle housing from a liquid inlet opening at one end of the passage, to a liquid outlet opening at the opposite end of the passage. The liquid inlet opening receives the liquid discharged from the trigger sprayer housing and the liquid discharge passage directs a flow of the liquid in a downstream direction from the inlet opening to the outlet opening of the liquid discharge passage.

A post is positioned in the liquid discharge passage. The post has a length that extends in the downstream direction from a proximal end of the post positioned in the liquid discharge passage, to a distal end of the post positioned adjacent the outlet opening of the liquid discharge passage. Four grooves are recessed into an exterior surface of the post. The grooves are spaced 90 degrees from each other around the circumference of the post, and the grooves extend parallel to each other across the post to the distal end of the post.

The nozzle cap is mounted on the nozzle housing for rotation of the cap on the housing. The nozzle cap has a tubular wall with an interior surface that surrounds the post of the nozzle housing. The tubular wall interior surface defines an interior bore of the nozzle cap. An oblong, slot-shaped outlet orifice is provided in the nozzle cap at one end of the interior bore. A pair of grooves are recessed into opposite sides of the tubular wall interior surface. The grooves extend in the downstream direction along the tubular wall interior surface and are aligned with the opposite ends of the oblong, slot-shaped orifice.

The nozzle cap is rotatable on the nozzle housing through 90 degree increments, or quarter turns, between first, second, third and fourth positions of the nozzle cap relative to the nozzle housing. In the first, second, third, and fourth positions of the nozzle cap relative to the nozzle housing, the pair of grooves in the nozzle cap tubular wall are aligned with a pair of grooves on the exterior of the nozzle housing post. This communicates the nozzle cap grooves with the nozzle housing grooves, and allows liquid to flow through the nozzle housing discharge passage and the nozzle cap interior bore, with the liquid being discharged from the nozzle assembly through oblong, slot-shaped outlet orifice of the nozzle cap. When the nozzle cap is in the first and third positions relative to the nozzle housing, the nozzle cap outlet orifice is oriented horizontally and the liquid is discharged in a horizontal fan spray pattern. When the nozzle cap is in the second and fourth positions relative to the nozzle housing, the liquid discharged from the nozzle cap orifice is discharged in a vertical fan spray pattern. When the nozzle cap is rotated to positions between the first, second, third, and fourth positions of the nozzle cap relative to the nozzle housing, the grooves of the nozzle cap and nozzle housing are not aligned and liquid flow through the nozzle assembly is prevented.

DESCRIPTION OF THE DRAWING FIGURES

Further features of the invention are set forth in the following detailed description of the preferred embodiment of the invention and are shown in the following drawing figures.

DESCRIPTION OF THE PREFERRED EMBODIMENT

Figure 1:
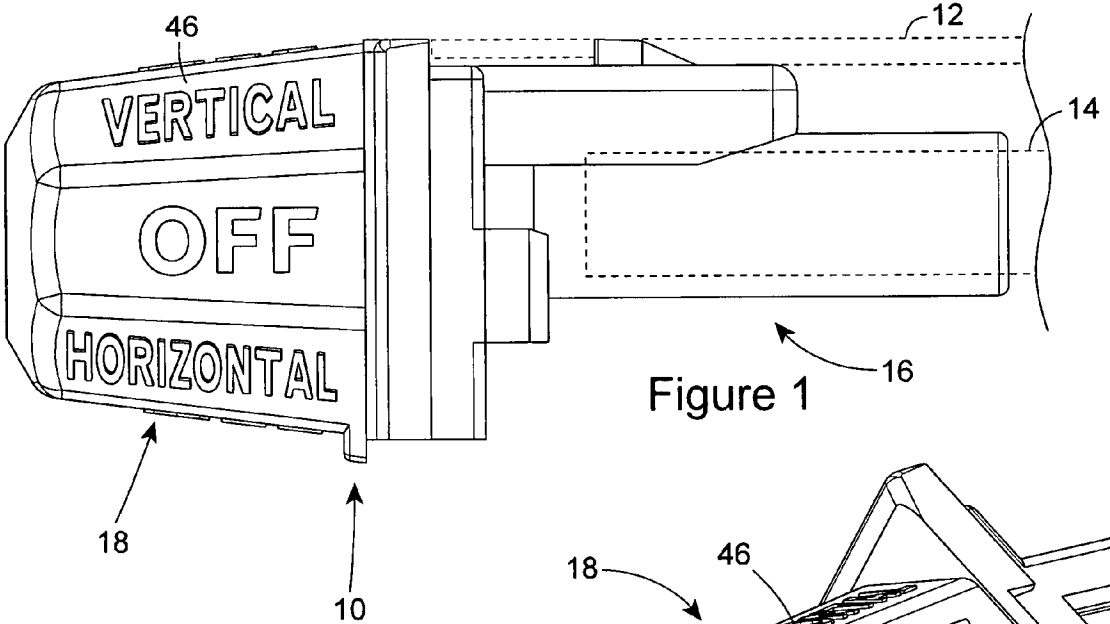
FIG. 1 is a side elevation view of the nozzle assembly of the invention mounted on a liquid discharge passage of a trigger sprayer shown in dashed lines.
Figure 2:
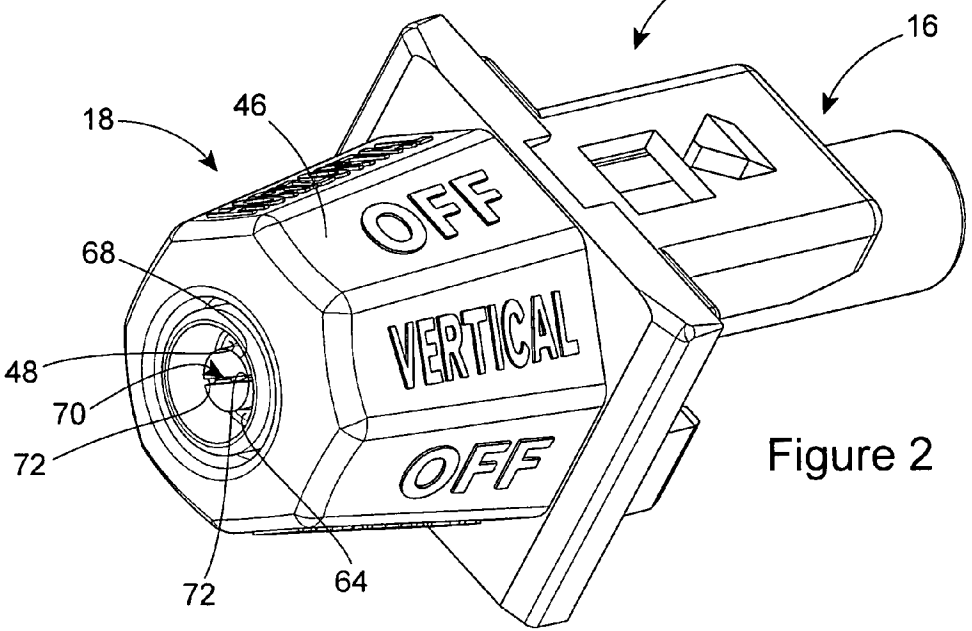
FIG. 2 is a front perspective view of the nozzle assembly of FIG. 1.
Figure 4:
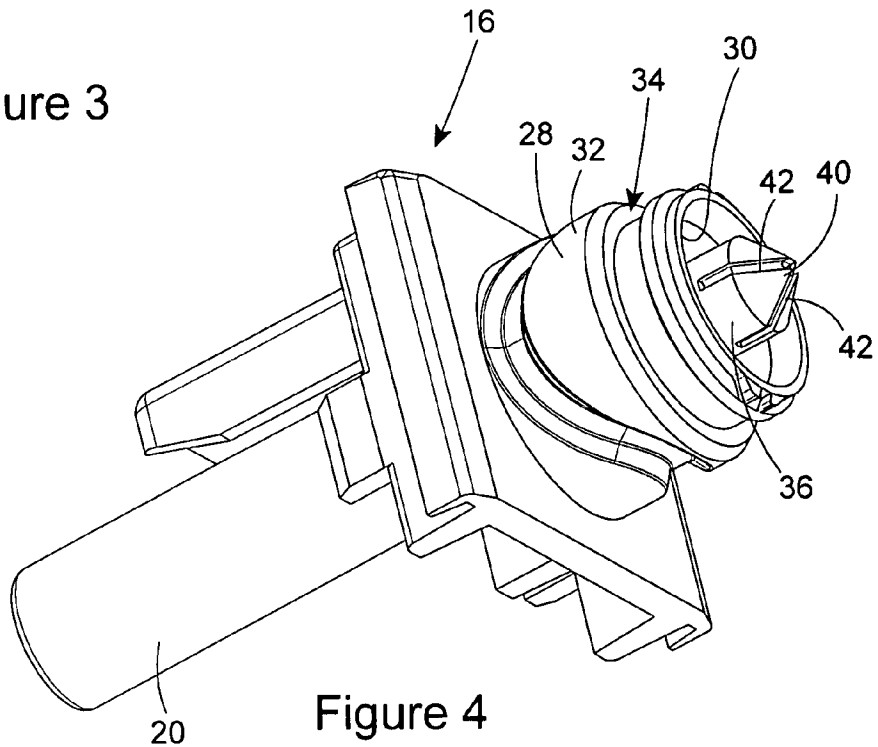
FIG. 4 is a front perspective view of the nozzle housing from the opposite side of the nozzle housing shown in FIG. 3.
Figure 3:
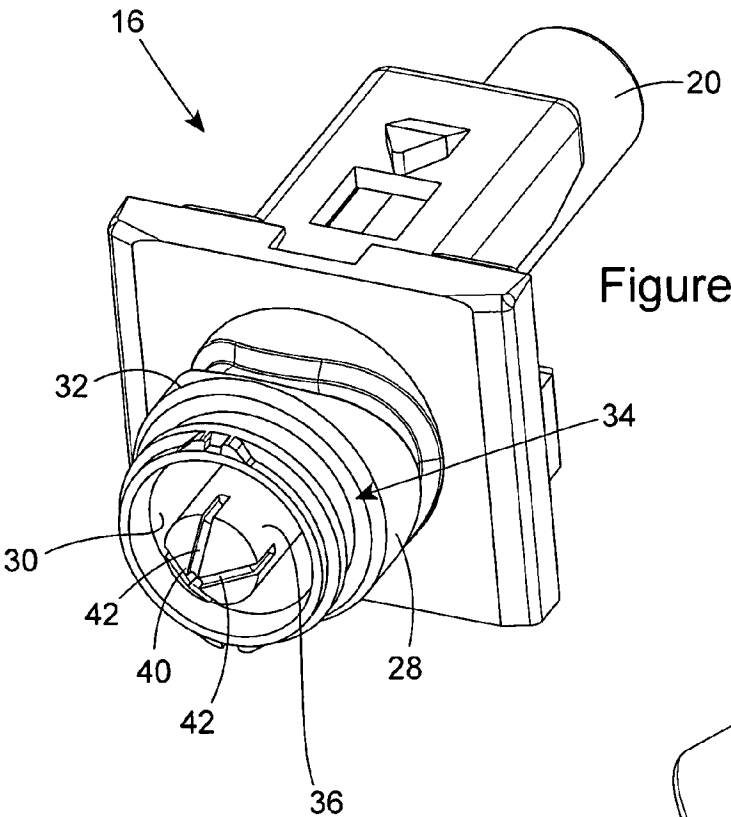
FIG. 3 is a front perspective view of the nozzle housing of the nozzle assembly with the nozzle cap removed.
Figure 5:
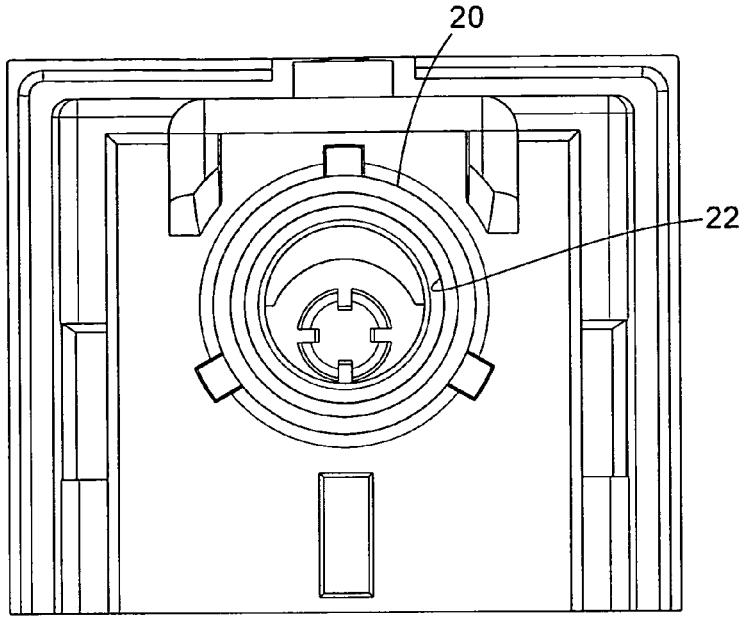
FIG. 5 is a rear elevation view of the nozzle housing.
Figure 6:
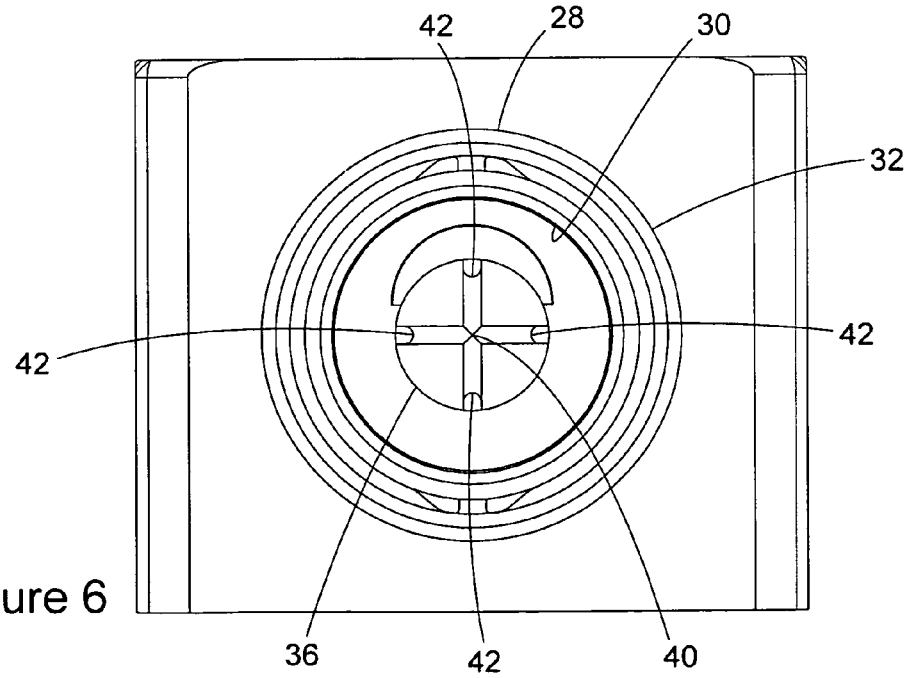
FIG. 6 is a front elevation view of the nozzle housing.
Figure 8:
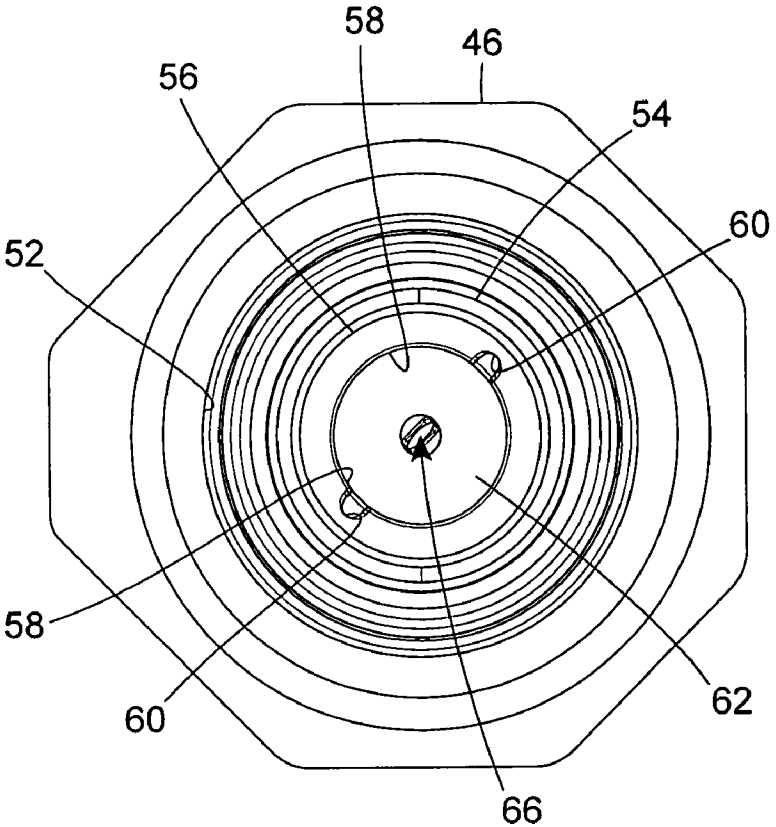
FIG. 8 is a rear elevation view of the nozzle cap removed from the nozzle housing.
Figure 7:
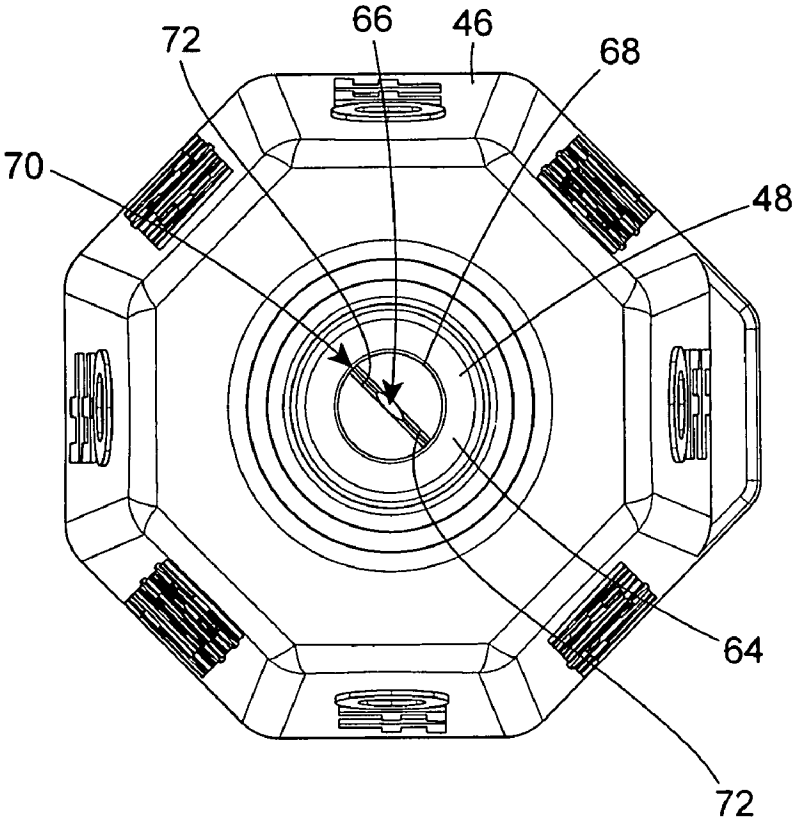
FIG. 7 is a front elevation view of the nozzle cap removed from the nozzle housing.
Figure 11:
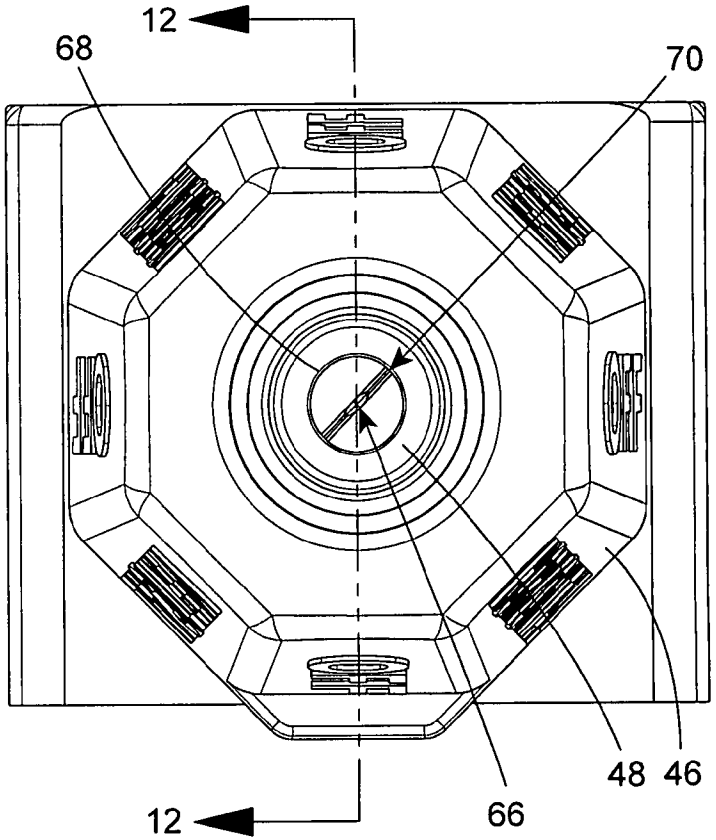
FIG. 11 is a front elevation view of the nozzle cap and nozzle housing.

FIG. 1 shows the nozzle assembly 10 of the invention assembled to a trigger sprayer 12 represented in dashed lines, with the nozzle assembly 10 communicating with the liquid discharge passage 14 of the trigger sprayer. The trigger sprayer 12 is shown in dashed lines in FIG. 1 because the nozzle assembly 10 of the invention is designed to be used with essentially any type of manually held and operated trigger sprayer. FIG. 2 shows a perspective view of the nozzle assembly 10 disassembled from the trigger sprayer 12. The nozzle assembly 10 is comprised of only two component parts, a nozzle housing 16 and a nozzle cap 18. The nozzle cap 18 is mounted on the nozzle housing 16 for free rotation of the cap 18 on the housing 16. Thus, the cap 18 can be rotated in opposite directions on the housing 16, and can be rotated more than one complete rotation on the housing. Both the nozzle housing 16 and nozzle cap 18 are constructed of plastic materials that are typically used in the construction of trigger sprayers.

Figure 12:
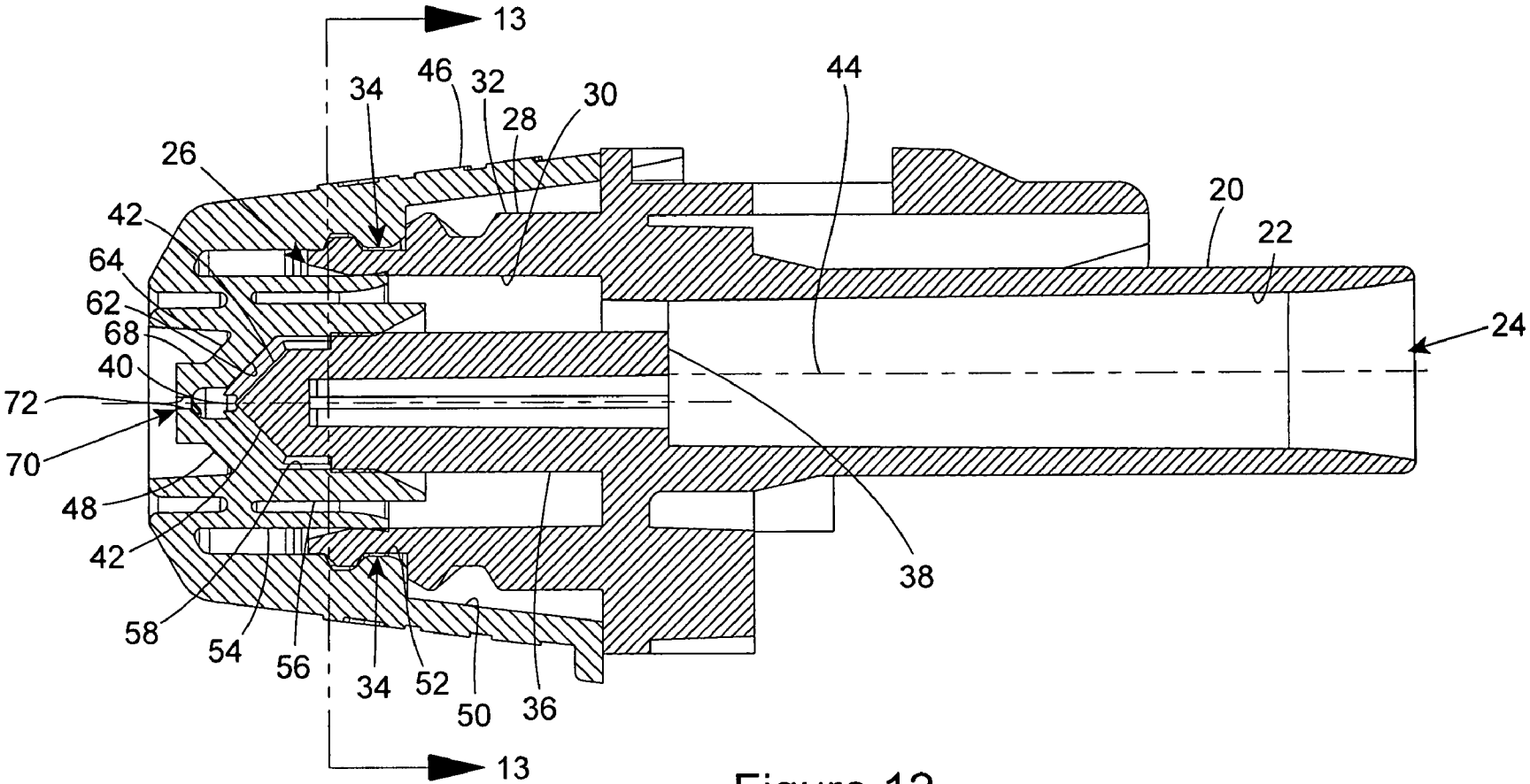
FIG. 12 is a side sectioned view of the nozzle cap and nozzle housing shown in FIG. 11, with the section being in the plan of line 12-12 of FIG. 11.

FIGS. 3-6 show the nozzle housing 16 of FIG. 2, with the nozzle cap 18 dissembled from the nozzle housing. The construction of the nozzle housing 16 can also be seen in the cross sections of the housing shown in FIGS. 10 and 12.

The nozzle housing 16 has a discharge tube 20 with a cylindrical interior surface 22 that defines an upstream portion of a liquid discharge passage of the nozzle assembly. The nozzle housing discharge tube 20 could be an integral extension of the trigger sprayer liquid discharge passage 14, or could be assembled to the discharge passage. The tube interior surface 22 extends in a downstream direction through the nozzle housing 16 from an inlet opening 24 of the liquid discharge passage, to a liquid outlet opening 26 of the liquid discharge passage. The liquid outlet opening 26 is surrounded by a cylindrical cap wall 28 of the nozzle housing 16. The cap wall 28 has a cylindrical interior surface 30 and an opposite exterior surface 32. The cap wall interior surface 30 defines a downstream portion of the liquid discharge passage. An annular groove 34 is formed in the cap wall exterior surface 32. The annular groove 34 mounts the nozzle cap 18 to the nozzle housing 16 for free rotating movement of the nozzle cap 18 on the nozzle housing 16, as will be explained.

A post 36 is positioned in the liquid discharge passage defined by the nozzle housing discharge tube interior surface 22 and the cap wall interior surface 30. The post 36 has a cylindrical exterior surface that extends from a proximal end 38 of the post positioned upstream in the nozzle housing liquid discharge passage, to a distal end 40 of the post positioned just outside of the nozzle housing liquid discharge passage. The post distal end 40 has an exterior surface with a conical configuration that projects outwardly from the outlet opening 26 of the nozzle housing liquid discharge passage.

A plurality of grooves 42 are recessed into the exterior surface of the post 36. In the preferred embodiment, the plurality of post grooves 42 are four grooves that are circumferentially spaced around the circumference of the post, with each of the grooves 42 being spaced 90 degrees from adjacent grooves on the post circumference. The grooves 42 have upstream portions that extend parallel to each other and parallel to a center axis 44 of the post 36, and downstream portions that converge toward each other and toward the post center axis 44. The downstream portions of the grooves 42 extend to the tip of the post distal end 40.

The nozzle housing 16 is also constructed with a flange 45 that extends over a portion of the liquid discharge tube 22. The flange 45 is employed in attaching the nozzle housing 16 to the trigger sprayer 12 in a conventional manner, with the nozzle housing liquid discharge tube 20 communicating with the trigger sprayer discharge passage 14.

The nozzle cap 18 has a generally cylindrical exterior wall 46 that extends around an interior volume of the nozzle cap. The exterior wall 46 tapers slightly toward an end wall 48 of the nozzle cap at one end of the exterior wall 46. The opposite end of the exterior wall 46 is open. The nozzle housing cap wall 28 extends through the opening and into the interior volume of the nozzle cap 18.

The nozzle cap exterior wall 46 has an interior surface 50 that opposes the nozzle housing cap wall 28. An annular rim 52 projects inwardly from the interior surface 50. The rim 52 is dimensioned to be received in the annular groove 34 on the nozzle housing cap wall 28. The engagement of the rim 52 in the annular groove 34 mounts the nozzle cap 18 on the nozzle housing 16 for free rotation of the cap on the housing. The engagement of the rim 52 in the annular groove 34 also prevents the nozzle cap 18 from being moved axially relative to the nozzle housing 16.

A cylindrical inner sealing wall 54 projects inwardly from the cap end wall 48 into the nozzle cap interior volume. The inner wall 54 is dimensioned to engage in a sealing, sliding engagement with the interior surface of the nozzle housing cap wall 28.

Figure 10:
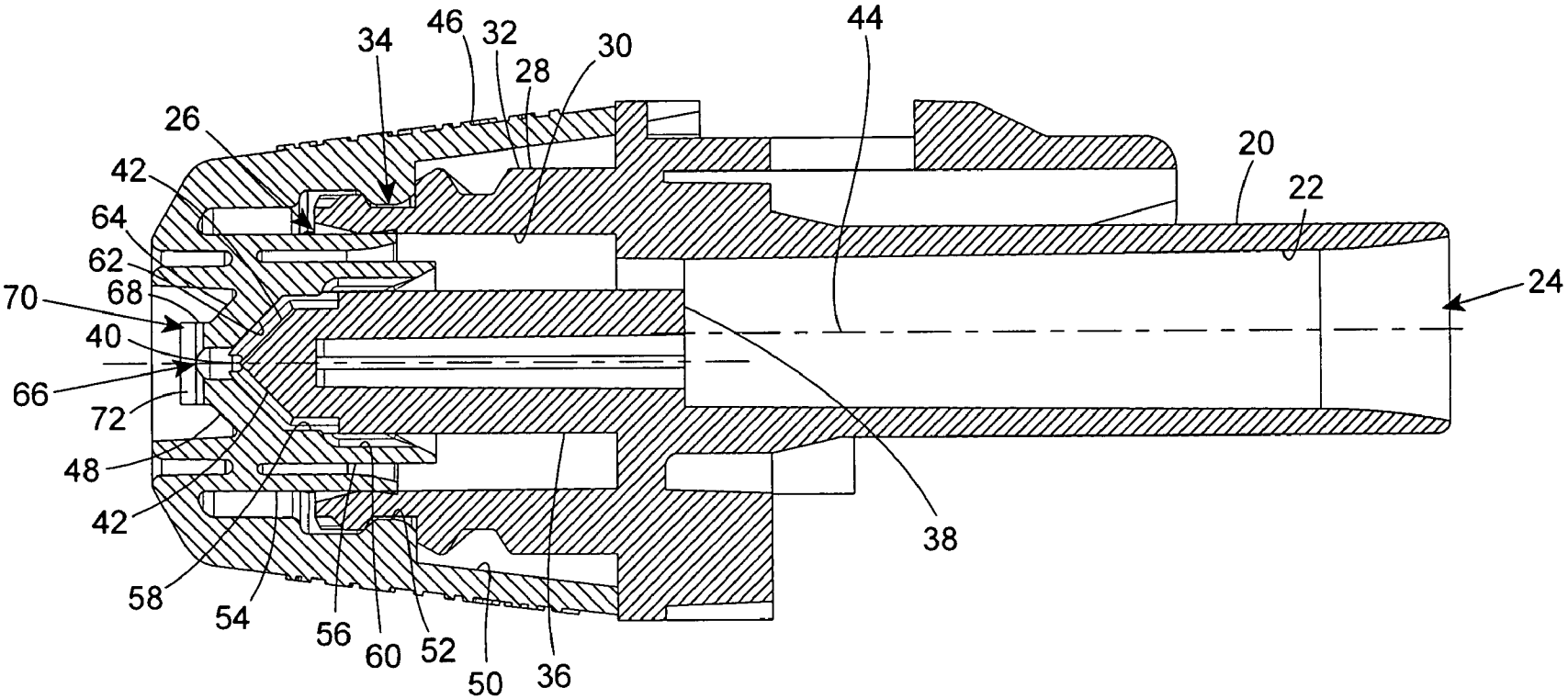
FIG. 10 is a side sectioned view of the nozzle cap and nozzle housing of FIG. 9, with the section being in the plain of line 10-10 of FIG. 9.

A cylindrical, tubular wall 56 also projects inwardly from the nozzle cap end wall 48. The tubular wall 56 is positioned concentrically inside the inner sealing wall 54 of the nozzle cap. The tubular wall 56 has a cylindrical interior surface 58 that surrounds and engages in sealing engagement with the exterior surface of the nozzle housing post 36. A pair of axial grooves 60 are recessed into the tubular wall interior surface 58. The tubular wall grooves 60 are positioned on diametrically opposite sides of the tubular wall 56 and extend parallel to each other along the tubular wall. As shown in FIG. 10, the tubular wall grooves 60 do not extend for the entire length of the tubular wall 56.

The nozzle cap end wall 48 inside the tubular wall 56 has a conical configuration. The conical shape gives the end wall a conical interior surface 62 and a conical exterior surface 64. The conical interior surface 62 mates in sliding engagement with the conical distal end surface 40 of the nozzle housing post 36. The conical interior surface 62 converges to an outlet orifice 66 that passes through the center of the nozzle cap end wall 48. The outlet orifice 66 has an oblong, slot-shaped configuration. The opposite ends of the slot-shaped orifice 66 align with the pair of grooves 60 in the interior surface 58 of the nozzle cap tubular wall 56.

A cylindrical projection 68 projects outwardly from the center of the conical end wall exterior surface 64. The projection 68 has a slot 70 formed through its center. The slot 70 is aligned with the elongate slot configuration of the orifice 66 and the interior of the slot 70 communicates with the orifice 66. The opposing planar surfaces 72 on the opposite sides of the projection slot 70 further form the discharge of liquid from the slot orifice 66 into a flat, fan-shaped spray pattern.

Figure 9:
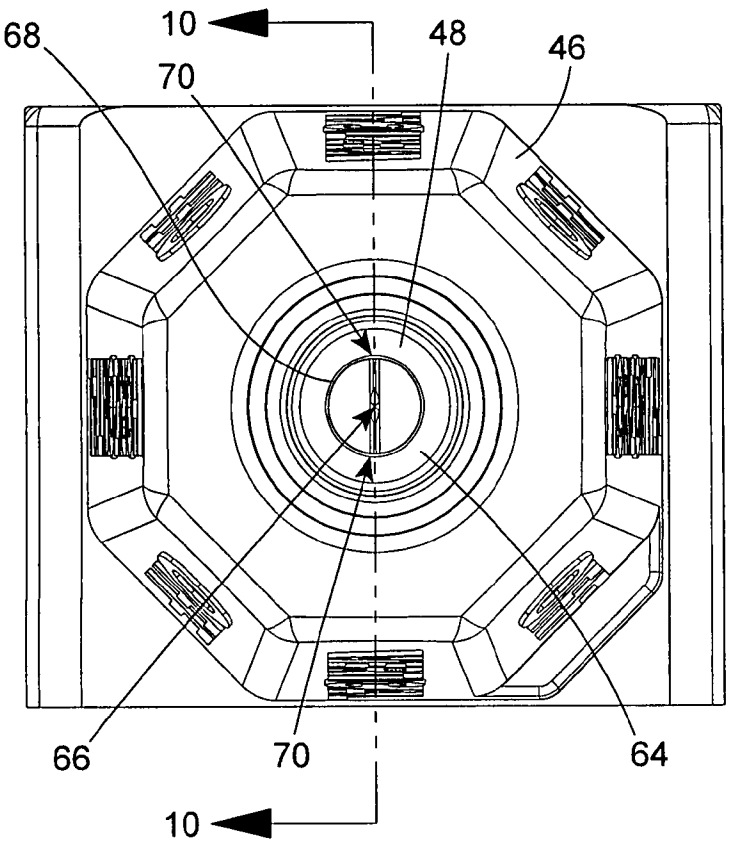
FIG. 9 is a front elevation view of the nozzle cap assembled to the nozzle housing.
Figure 14:
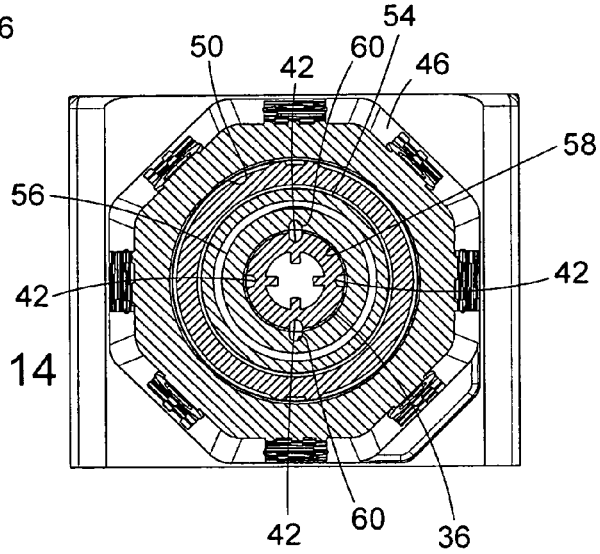
FIG. 14 is a cross section view similar to that of FIG. 13, but showing the relative positions of the nozzle cap and nozzle housing in the vertical fan spray positions.
Figure 15:
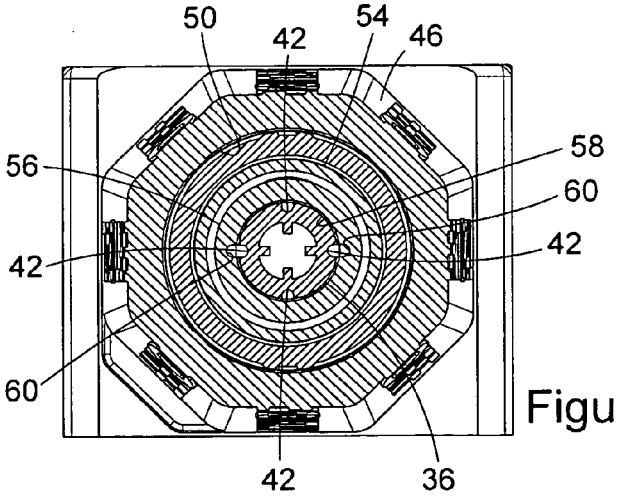
FIG. 15 is a view similar to FIG. 13, but showing the relative positions of the nozzle cap and nozzle housing in the horizontal spray positions.

With the relative positions of the four post grooves 42 on the exterior of the nozzle housing post 36, and the two tubular wall grooves 60 in the interior surface 58 of the nozzle cap tubular wall 56, it can be seen that the two tubular wall grooves 60 will align with a pair of the nozzle housing post grooves 48 when the nozzle cap 18 is rotated relative to the nozzle housing 16 so that the elongate slot orifice 60 is positioned vertically as shown in FIGS. 9 and 14, and is positioned horizontally as shown in FIG. 15. In these positions of the nozzle cap 18 relative to the nozzle housing 16, the nozzle housing post grooves 42 are aligned with the nozzle cap tubular wall groove 60 and fluid is permitted to flow through the aligned grooves and exit through the slot orifice 66. The slot configuration of the orifice 66 and the opposing surfaces 72 of the cap projection slot 70 form the discharged liquid in a flat fan pattern. FIGS. 9 and 14 show the nozzle cap 18 in a first position relative to the nozzle housing 16. In this position of the nozzle cap 18, the liquid discharged from the cap orifice 66 is formed in a vertical fan spray pattern. Rotating the nozzle cap 18 ninety degrees or one-quarter rotation to a second position of the nozzle cap 18 relative to the nozzle housing 16 will position the cap and housing in the position shown in FIG. 15. In this second position of the nozzle cap 18 relative to the nozzle housing 16, the discharge of liquid from the nozzle cap orifice 66 will be in a horizontal fan spray pattern. Rotating the nozzle cap 18 an additional ninety degrees or one-quarter turn in the same direction will position the nozzle cap 18 in a third position relative to the nozzle housing 16, which is basically the same as that shown in FIG. 14. Rotating the nozzle cap 18 an additional ninety degrees or one-quarter turn in the same direction will position the nozzle cap 18 in a fourth position relative to the nozzle housing 16, which is basically the same as that shown in FIG. 15. Thus, in the first and third positions of the nozzle cap 18 relative to the nozzle housing 16, the spray discharged from the nozzle assembly 10 is in a vertical fan pattern, and in the second and fourth positions of the nozzle cap 18 relative to the nozzle housing 16, the spray discharged from the nozzle assembly 10 is in a horizontal fan spray pattern.

Figure 13:
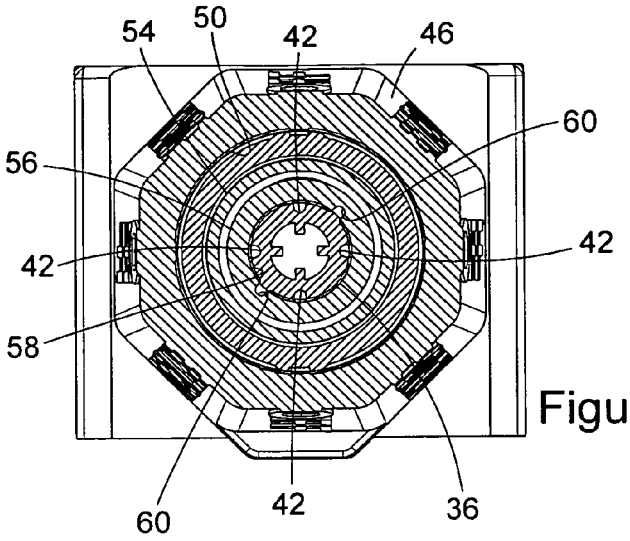
FIG. 13 is a front sectioned view through the nozzle assembly, with the section being in the plan of line 13-13 of FIG. 12.

When the nozzle cap 18 is rotated relative to the nozzle housing 16 to positions between the first, second, third, or fourth positions, the nozzle cap tubular wall grooves 60 are not aligned with the nozzle housing post grooves 42 and liquid discharge through the nozzle assembly 10 is prevented. An example of this situation is shown in FIG. 13.

Thus, the nozzle assembly 10 of the present invention provides a nozzle assembly of simplified, two-piece construction, that is easily adjusted to discharge liquid in either a vertical fan spray pattern or a horizontal fan spray pattern, or is adjusted to an off position where the discharge of liquid through the nozzle assembly 10 is prevented.

Although the nozzle assembly of the invention has been described above with reference to a specific embodiment of the invention, it should be understood that modifications and variations could be made to the embodiment described without departing from the intended scope of the application claims.

The invention claimed is:

1. A nozzle assembly of a trigger sprayer comprising:

a nozzle housing on the trigger sprayer to receive liquid discharged from the trigger sprayer on operation of the trigger sprayer;

a liquid discharge passage extending through the nozzle housing from an inlet opening of the liquid discharge passage that receives liquid discharged from the trigger sprayer, to an outlet opening of the liquid passage that discharges liquid from the liquid discharge passage;

a post extending through the liquid discharge passage from a proximal end of the post positioned in the liquid discharge passage to a distal end of the post positioned adjacent the outlet opening of the liquid discharge passage, the post having a cylindrical exterior surface with a center axis and a plurality of grooves recessed into the exterior surface and extending axially along the post exterior surface;

a nozzle cap mounted on the nozzle housing for rotation of the cap between first, second, third and fourth positions of the nozzle cap on the nozzle housing, the nozzle cap being rotated one quarter of a complete rotation between the first and second positions, and rotated one quarter of a complete rotation between the second and third positions, and one quarter of a complete rotation between the third and fourth positions, and one quarter of a complete rotation between the fourth and first positions; and a tubular wall on the nozzle cap having a cylindrical interior surface that extends around the nozzle housing post exterior surface, the cylindrical interior surface having a center axis that is coaxial with the post center axis and the cylindrical interior surface defining an interior bore of the tubular wall that extends between an inlet opening at one end of the tubular wall that receives liquid discharged from the nozzle housing discharge passage and an opposite outlet orifice having an oblong shape that discharges liquid received from the nozzle housing liquid discharge passage from the nozzle cap, the tubular wall interior surface having a plurality of grooves recessed into the interior surface and extending axially along the interior surface where at least one groove in the tubular wall interior surface aligns with at least one groove in the nozzle housing post exterior surface in each of the first, second, third and fourth positions of the nozzle cap on the nozzle housing.

2. The nozzle assembly of claim 1, further comprising:

the plurality of grooves recessed into the nozzle housing post exterior surface having portions that extend axially parallel and having portions that axially converge.

3. The nozzle assembly of claim 1, further comprising:

the plurality of grooves recessed into the interior surface of the nozzle cap tubular wall being axially parallel.

4. The nozzle assembly of claim 1, further comprising:

the nozzle cap oblong shape outlet orifice having opposite ends that align with and communicate with a pair of grooves of the plurality of grooves recessed into the tubular wall interior surface.

5. The nozzle cap assembly of claim 1, further comprising:

a projection on the nozzle cap, the projection having a slot with opposed surfaces, and the opposed surfaces being on opposite sides of and aligned with the oblong shape of the outlet orifice.

* * * * *